US007637398B2

(12) United States Patent
Sung

(10) Patent No.: US 7,637,398 B2
(45) Date of Patent: Dec. 29, 2009

(54) PNEUMATIC DISPENSING GUN

(75) Inventor: Chia Hsien Sung, Taichung (TW)

(73) Assignee: Kent Bridge Enterprise Co., Ltd., Taichung (TW)

( * ) Notice: Subject to any disclaimer, the term of this patent is extended or adjusted under 35 U.S.C. 154(b) by 372 days.

(21) Appl. No.: 11/787,751

(22) Filed: Apr. 17, 2007

(65) Prior Publication Data

US 2008/0257914 A1 Oct. 23, 2008

(51) Int. Cl.
*B67D 5/42* (2006.01)

(52) U.S. Cl. ..... 222/389; 222/397

(58) Field of Classification Search ..... 222/389, 222/239, 325–327, 261–263, 396–399, 387
See application file for complete search history.

(56) References Cited

U.S. PATENT DOCUMENTS 3,910,466 A * 10/1975 Collar ..... 222/327
4,174,068 A * 11/1979 Rudolph ..... 239/322
5,058,769 A 10/1991 Kurtz ..... 222/47
5,156,305 A 10/1992 Eyre ..... 222/327
5,626,263 A 5/1997 Lii ..... 222/192
7,334,709 B1 * 2/2008 Huang ..... 222/334

* cited by examiner

*Primary Examiner*—Lien T Ngo
(74) *Attorney, Agent, or Firm*—Charles E. Baxley

(57) ABSTRACT

A pneumatic dispensing gun includes a receptacle having a conduit for receiving a pressurized gas, a cartridge supported on the receptacle, an end cap attached to the cartridge and having a path communicating with the conduit of the receptacle, and a regulating device attached to the end cap for regulating the pressurized gas or for allowing pressurized gas supplied to the dispensing gun to be released when required, and for preventing the pressurized gas supplied to the dispensing gun from being over pressurized, and thus for suitably and adjustably dispensing the flowable material from the cartridge.

13 Claims, 4 Drawing Sheets

PNEUMATIC DISPENSING GUN

BACKGROUND OF THE INVENTION

1. Field of the Invention

The present invention relates to a pneumatic dispensing gun, and more particularly to a pneumatic dispensing gun including an adjusting or pressure regulating device for regulating the pneumatic pressure and for suitably or adjustably dispensing the flowable materials from the prefilled packages or cartridges.

2. Description of the Prior Art

Typical dispensing guns or caulk guns or extrusion devices comprise a C-shaped frame or a receptacle attached to a gun body for receiving a prefilled package or cartridge therein, and a push rod engageable into the prefilled package or cartridge, and an actuating or driving handle coupled to the push rod for applying a force to dispense or to distribute the flowable materials from the prefilled packages or cartridges.

For example, U.S. Pat. No. 5,156,305 to Eyre, and U.S. Pat. No. 5,626,263 to Lii disclose two of the typical caulk dispensing guns or C-clamp assemblies and each also including a receptacle or cartridge keep attached to or extended from a gun body or stock for receiving a prefilled package or cartridge therein, and an actuating or driving handle coupled to a push rod which is engageable into the prefilled package or cartridge for forcing the push rod to dispense or to distribute the flowable materials from the prefilled packages or cartridges.

However, the users have to spend a great force to pull or to trigger the actuating or driving handle in order to dispense or to distribute the flowable materials from the prefilled packages or cartridges, such that the typical caulk dispensing guns are not good for long term working people.

U.S. Pat. No. 5,058,769 to Kurtz discloses another typical pneumatic caulk dispensing gun including a gun body member for receiving a prefilled package or cartridge therein, and a connector for coupling to a pressurized air supplier reservoir or a pressurized gas source for receiving the pressurized air or gas and for forcing or dispensing or distributing the flowable materials from the prefilled packages or cartridges.

However, the pressurized gas supplied from the pressurized air supplier reservoir or gas source may not be regulated or adjusted particularly when the pressurized air or gas is over-pressurized or when the pressurized air or gas is not stable or steady.

The present invention has arisen to mitigate and/or obviate the afore-described disadvantages of the conventional dispensing guns or devices for dispensing or distributing the flowable materials from the prefilled packages or cartridges.

SUMMARY OF THE INVENTION

The primary objective of the present invention is to provide a pneumatic dispensing gun including an adjusting or pressure regulating device for regulating the pneumatic pressure or for allowing pressurized gas supplied to the dispensing gun to be released when required, and for preventing the pressurized air or gas supplied to the dispensing gun from being over pressurized, and for suitably or adjustably dispensing the flowable materials from the prefilled packages or cartridges.

In accordance with one aspect of the invention, there is provided a pneumatic dispensing gun comprising a receptacle including a conduit formed therein for receiving a pressurized gas, a cartridge supported on the receptacle and including one end portion, an end cap attached to the one end portion of the cartridge, and including a path formed therein for communicating with the conduit of the receptacle and for communicating with the one end portion of the cartridge and for supplying the pressurized gas into the cartridge, and a regulating device attached to the end cap for regulating the pressurized gas.

The regulating device includes a valve device resiliently engaged with the end cap and for selectively blocking the path of the end cap. The end cap includes a compartment formed in a rear portion of the end cap and communicating with the path of the end cap, and the valve device is slidably disposed and engaged in the compartment of the end cap.

The valve device includes a casing and a frustum-shaped skirt extended from the casing for resiliently engaging with the end cap. The valve device includes a recess formed in the casing and facing toward the path of the end cap.

The valve device includes a spring biasing device for biasing the valve device to resiliently engage with the end cap. A coupler is further provided and attached to the valve device, and the spring biasing device includes a spring member engaged with the coupler for biasing the valve device to resiliently engage with the end cap.

The valve device includes a control ferrule attached to the end cap and having a chamber formed in the control ferrule, and an anchor disposed in the chamber of the control ferrule and engaged with the spring member. The anchor includes a cavity formed therein for receiving the spring member.

The coupler includes an extension extended therefrom for engaging with the spring member and for anchoring the spring member. The valve device includes a casing, and the coupler includes a depression formed by a peripheral wall for receiving the casing and for anchoring the coupler to the valve device.

The control ferrule includes a peripheral flap extended radially and inwardly for forming an opening in the peripheral flap of the control ferrule, and the anchor includes a protrusion extended therefrom and engaged through the opening of the control ferrule for anchoring the anchor to the control ferrule.

The peripheral flap of the control ferrule includes a number of orifices formed therein, and arranged around the opening of the peripheral flap for air circulating purposes. The control ferrule is adjustably attached to the end cap.

A connector is further provided and attached to the end cap, and a tube includes a first end secured to the receptacle and a second end slidably and adjustably engaged with the connector, and the tube includes a bore formed therein and communicating with the conduit of the receptacle.

The connector includes a first segment attached to the end cap, and a second segment, and includes a pathway formed in the first segment and the second segment, the second end of the tube is slidably and adjustably engaged in the pathway of the connector.

The receptacle includes a handle extended from the receptacle and having a passage formed in the handle and communicating with the conduit of the receptacle.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
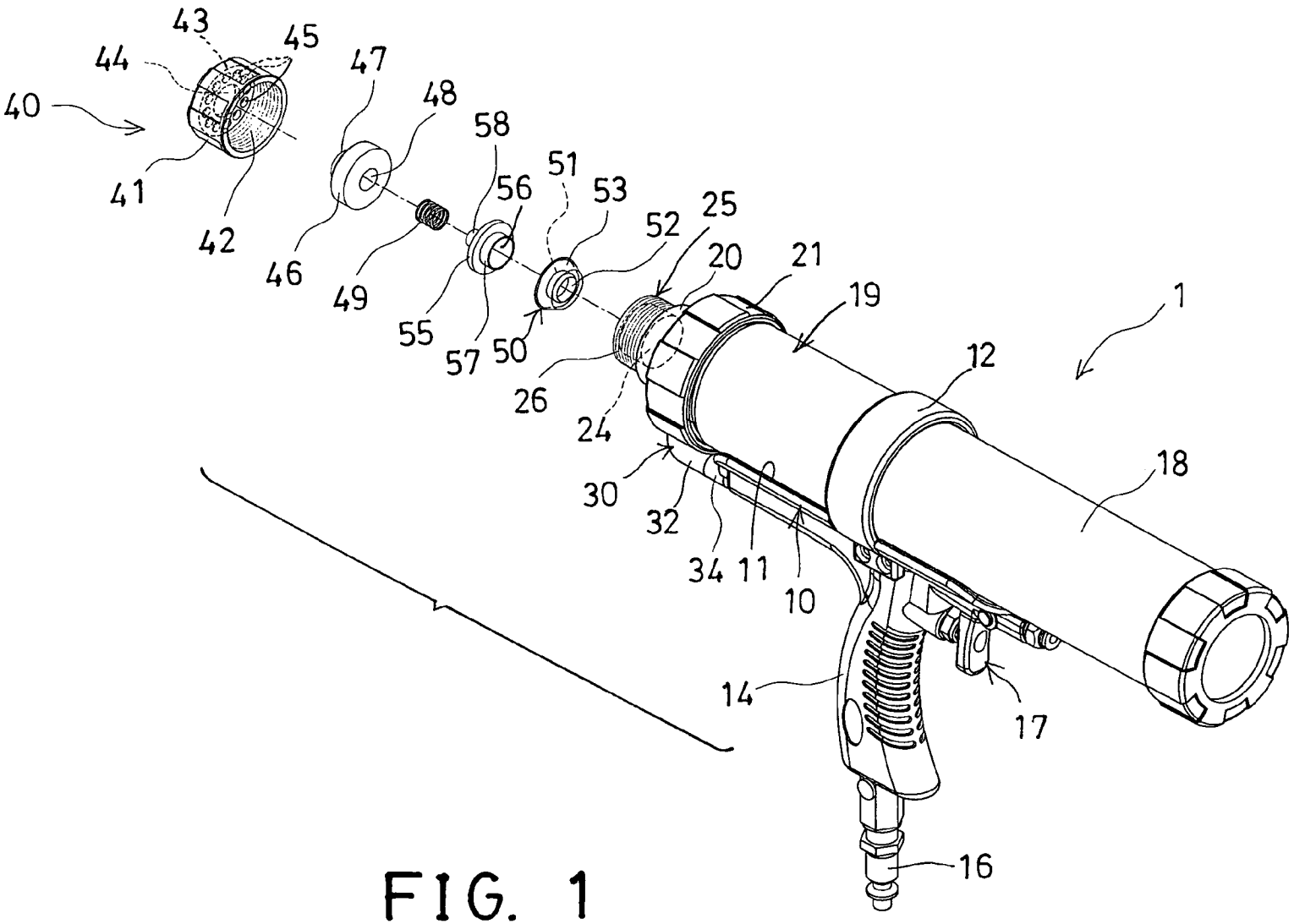
FIG. 1 is a partial exploded view of a pneumatic dispensing gun in accordance with the present invention.
Figure 2:
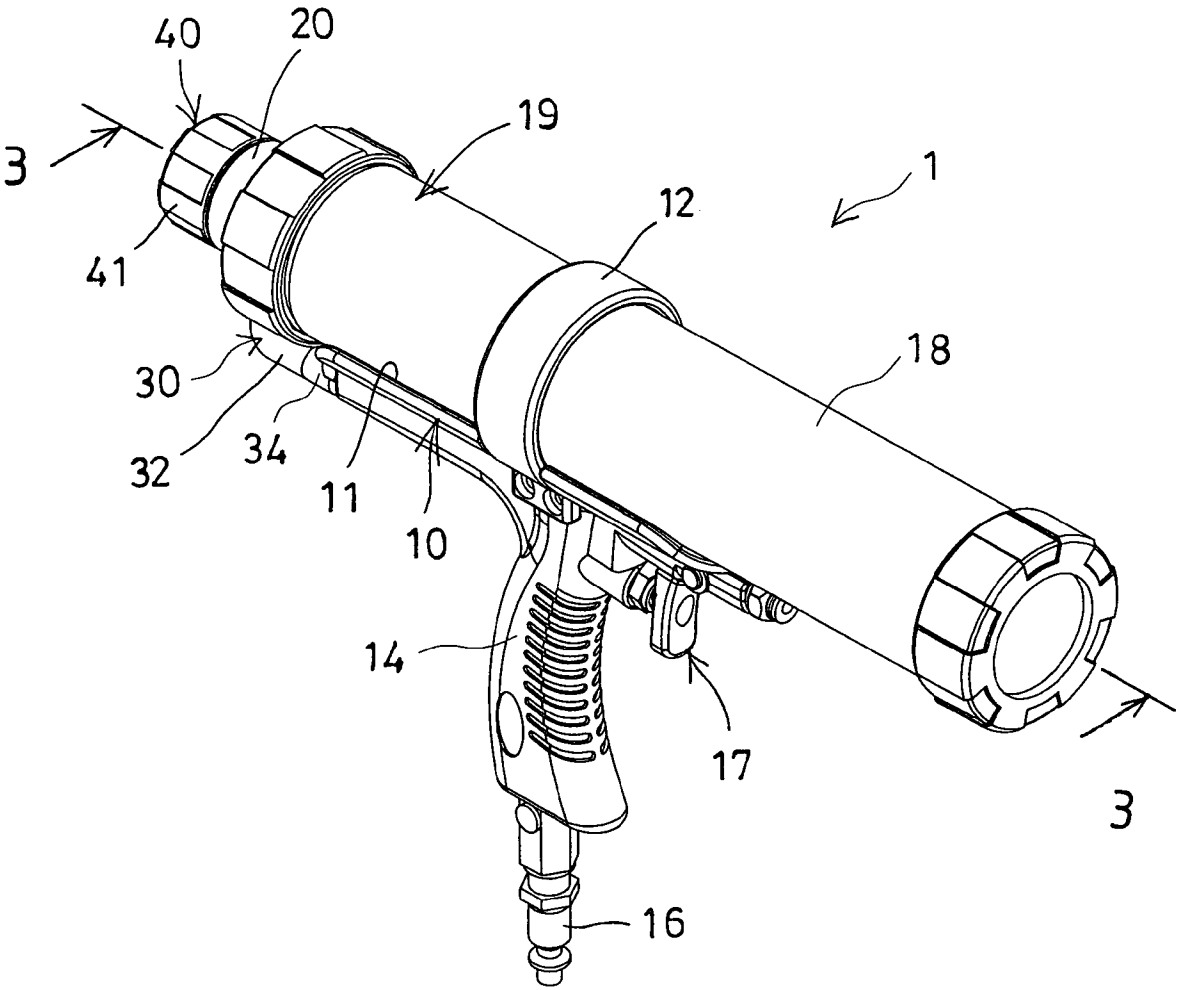
FIG. 2 is a front perspective view of the pneumatic dispensing gun.
Figure 3:
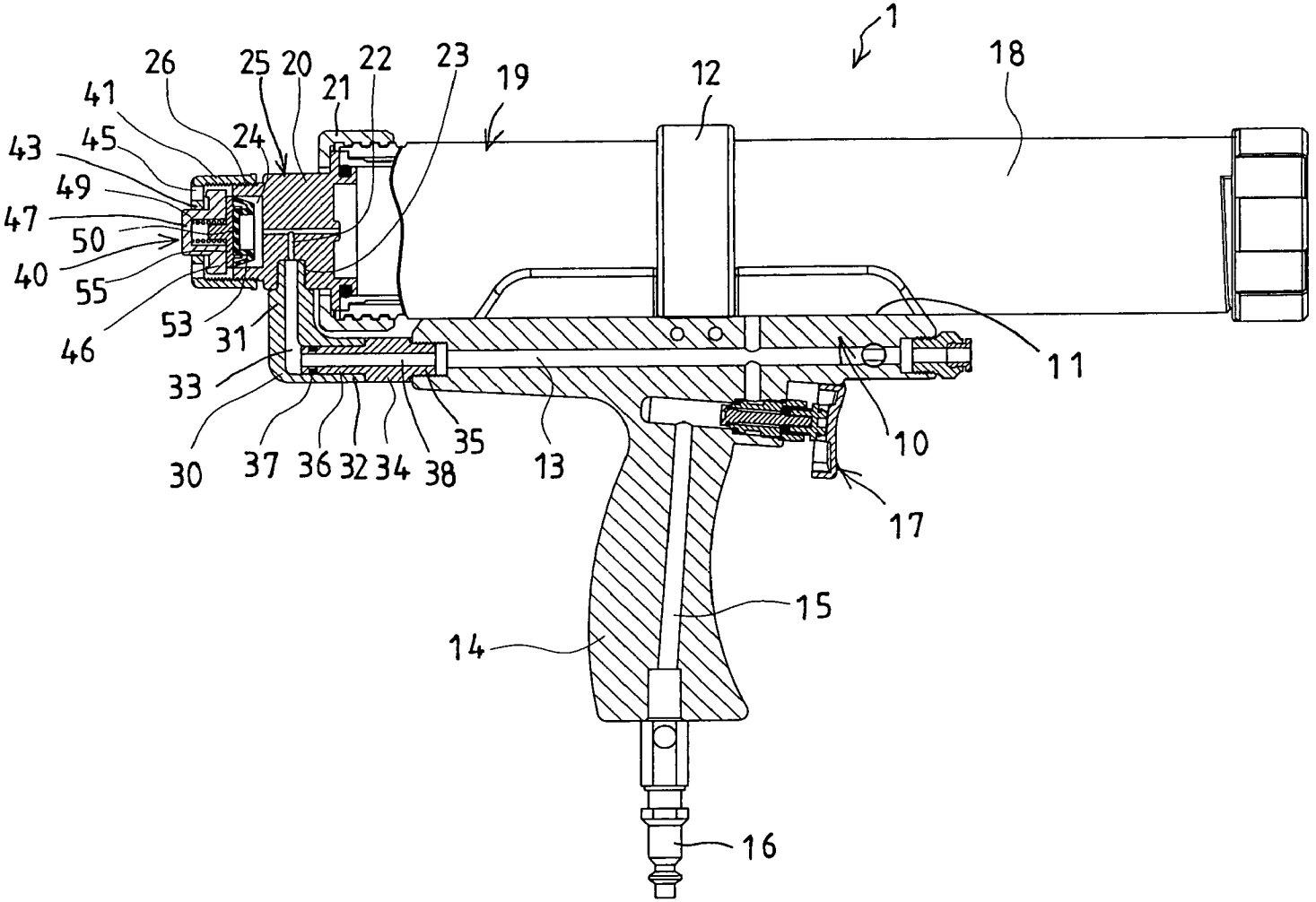
FIG. 3 is a partial cross sectional view of the pneumatic dispensing gun taken along lines 3-3 of FIG. 2.

Referring to the drawings, and initially to FIGS. 1-3, a pneumatic dispensing gun 1 in accordance with the present invention comprises a gun body or frame or receptacle 10 including a space or chamber 11 formed therein, such as formed in the upper portion thereof for receiving a prefilled package or cartridge 18 therein, and a C-ring or retaining device 12 attached to the receptacle 10 and engageable with the prefilled package or cartridge 18 for stably coupling or retaining the prefilled package or cartridge 18 to the receptacle 10, and for preventing the prefilled package or cartridge 18 from being disengaged from the receptacle 10, the receptacle 10 include an air or gas or fluid conduit 13 formed therein, such as formed in the lower portion thereof and located below the chamber 11 of the receptacle 10 and/or the prefilled package or cartridge 18.

The receptacle 10 further includes a handle 14 extended downwardly from the gun body or receptacle 10 and having an air or gas or fluid passage 15 formed in the handle 14 and intersecting or communicating with the conduit 13 of the receptacle 10, and includes a port or mouth 16 attached to the handle 14 for coupling to a pressurized air supplier reservoir or a pressurized gas source (not shown) and for receiving the pressurized air or gas from the pressurized gas source and also for supplying the pressurized air or gas to the passage 15 of the handle 14 and the conduit 13 of the receptacle 10. A control device or trigger 17 is slidably attached to the handle 14 and/or to the receptacle 10, and arranged or disposed between the passage 15 of the handle 14 and the conduit 13 of the receptacle 10 for triggering or controlling the pressurized air or gas to flow from the passage 15 of the handle 14 to the conduit 13 of the receptacle 10.

An end cap 20 is attached to or engaged with the one end or rear portion 19 of the cartridge 18 and secured to the rear portion 19 of the cartridge 18 with such as fasteners or latches (not shown), or a lock ferrule 21, and includes a T-shaped air or gas or fluid path 22 formed therein and communicating with the rear portion 19 of the cartridge 18 for supplying the pressurized air or gas into the cartridge 18, and includes a port 23 formed therein and communicating with the path 22 of the end cap 20, an L-shaped elbow or connector 30 includes two segments 31, 32 having one of the segments 31 coupled or engaged with the port 23 of the end cap 20, and includes an L-shaped pathway 33 formed therein and communicating with the path 22 of the end cap 20, and for communicating with the conduit 13 of the receptacle 10 and thus the passage 15 of the handle 14.

A tube 34 includes one end 35 threaded or secured to the receptacle 10, and another end 36 slidably or adjustably received or engaged within the pathway 33 of the other segment 32 of the connector 30, and includes a sealing ring 37 engaged onto the outer peripheral portion of the other end 36 of the tube 34 for making a water tight seal or an air tight seal between the other segment 32 of the connector 30 and the tube 34 and for allowing the other end 36 of the tube 34 to be slid or moved or adjusted relative to the other segment 32 of the connector 30. The tube 34 includes a bore 38 formed therein and communicating with the pathway 33 of the connector 30 and also communicating with the conduit 13 of the receptacle 10 and thus the passage 15 of the handle 14, and thus for allowing the pressurized air or gas to be supplied from the passage 15 and the mouth 16 of the handle 14 to the conduit 13 of the receptacle 10 and then to the pathway 33 of the connector 30 and also to the path 22 of the end cap 20.

The end cap 20 further includes a compartment 24 formed in the rear portion 25 of the end cap 20 and opened or facing rearwardly, and includes an outer thread 26 formed on the outer peripheral portion of the rear portion 25 of the end cap 20 for attaching an adjusting or pressure regulating device 40 which is provided for regulating the pneumatic pressure or air or gas pressure and for suitably or adjustably dispensing the flowable materials from the prefilled packages or cartridges 18. For example, the regulating device 40 includes a control ferrule 41 threaded or secured to the rear portion 25 of the end cap 20 with such as the threading engagement or the outer thread 26 of the end cap 20, and includes a chamber 42 formed in the control ferrule 41, the control ferrule 41 includes a peripheral flap 43 extended radially and inwardly from the rear portion of the control ferrule 41 for forming or defining an opening 44 in the peripheral flap 43 or in the control ferrule 41.

Figure 5:
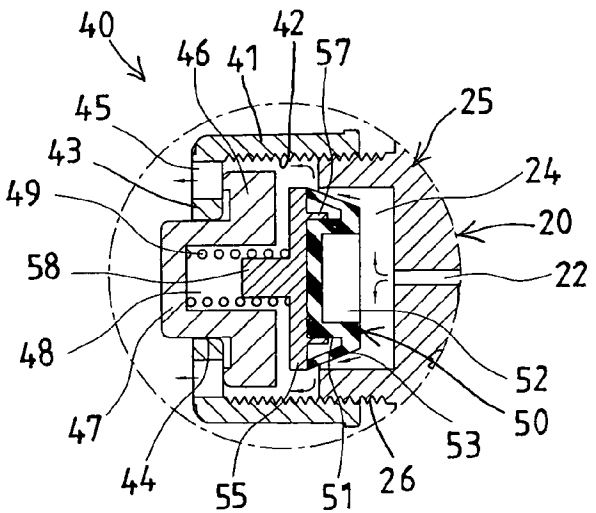
FIG. 5 is an enlarged partial cross sectional view of the pneumatic dispensing gun as shown in FIG. 4.

It is preferable that the control ferrule 41 further includes a number of orifices 45 formed therein, such as formed in the peripheral flap 43 preferably arranged or located around the opening 44 of the peripheral flap 43 for air circulating purposes. An anchor 46 is disposed or received or engaged within the chamber 42 of the control ferrule 41, and includes an outer diameter smaller than an inner diameter of the chamber 42 of the control ferrule 41 for allowing the pressurized air or gas to bypass the anchor 46 and to flow out through the opening 44 and/or the orifices 45 of the peripheral flap 43 (FIG. 5). The anchor 46 includes a protrusion 47 extended outwardly therefrom and engaged through the opening 44 of the control ferrule 41 for anchoring or positioning the anchor 46 to the control ferrule 41 and for preventing the anchor 46 from being disengaged from the control ferrule 41. The anchor 46 includes a cavity 48 formed therein or formed in the protrusion 47 for receiving a spring biasing means or member 49.

A valve device 50 includes a U or C-shaped casing 51 slidably disposed or received or engaged within the compartment 24 of the end cap 20 and having a recess 52 formed therein and opened or facing toward the path 22 of the end cap 20, and includes a cone-shaped or inclined or frustum-shaped skirt 53 provided or extended outwardly therefrom for resiliently engaging with the rear portion 25 of the end cap 20 and for selectively blocking or enclosing the compartment 24 and/or the path 22 of the end cap 20, a coupler 55 includes a depression 56 formed in one end or the front portion thereof and formed or defined by a peripheral wall 57 for receiving the casing 51 of the valve device 50 and for anchoring or positioning or attaching the coupler 55 to the valve device 50, and the coupler 55 includes an extension 58 extended outwardly therefrom for engaging with the spring member 49 and for stably anchoring or positioning the spring member 49 between the coupler 55 and the anchor 46 and the control ferrule 41.

Figure 4:
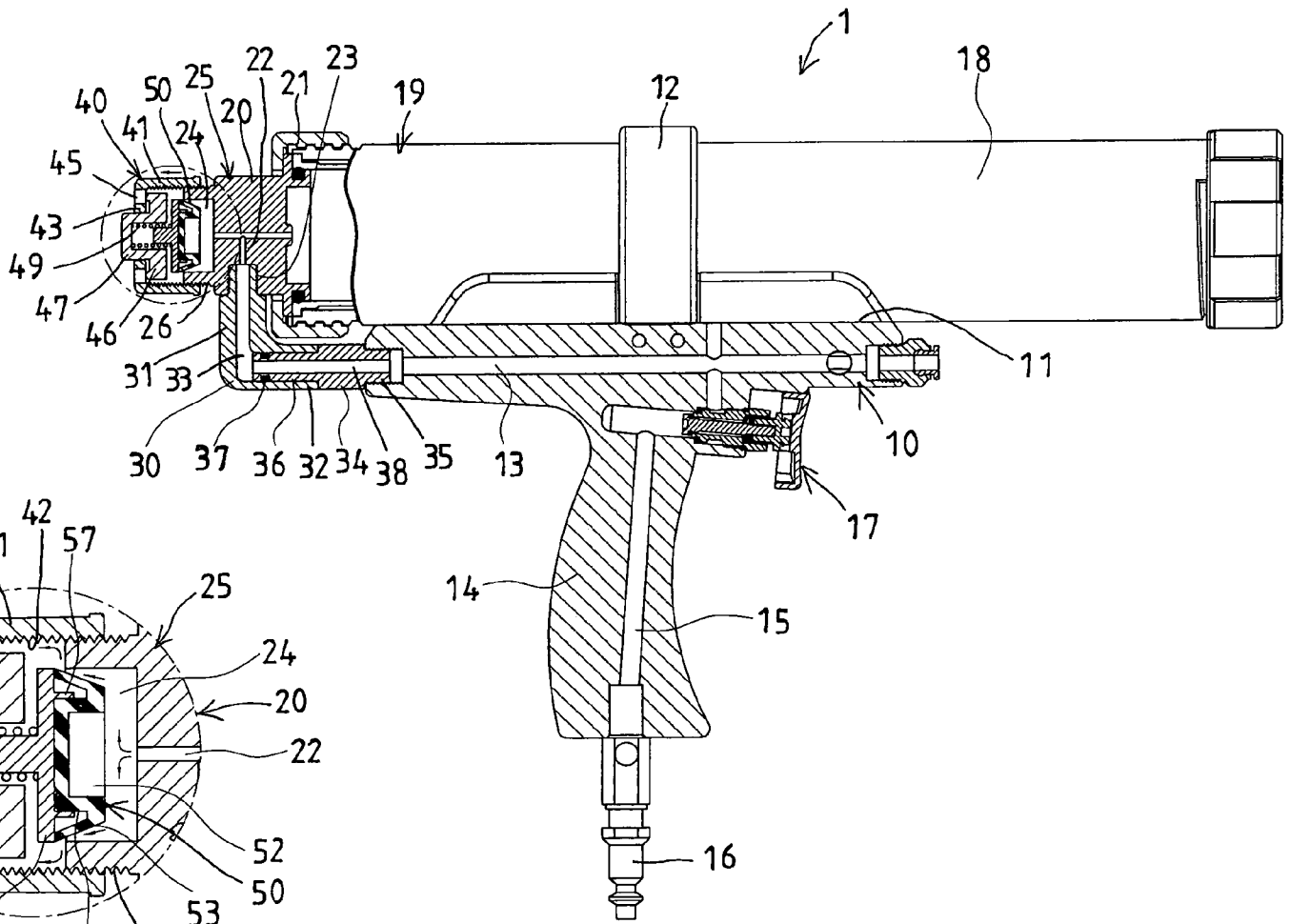
FIG. 4 is a partial cross sectional view similar to FIG. 3, illustrating the operation of the pneumatic dispensing gun.

In operation, as shown in FIGS. 3, and 4, the spring member 49 may bias and force the valve device 50 toward the end cap 20, and may bias and force the skirt 53 of the valve device 50 to resiliently engage with the rear portion 25 of the end cap 20 and to selectively block or close the compartment 24 and/or the path 22 of the end cap 20, and thus to prevent the pressurized air or gas to flow out through the opening 44 and/or the orifices 45 of the peripheral flap 43 of the control ferrule 41. The control ferrule 41 may be threaded and moved toward and away from or relative to the rear portion 25 of the end cap 20 for adjusting the spring biasing force of the spring member 49 against the coupler 55 and the valve device 50, and thus for adjusting the pressurized air or gas that may be allowed to flow out through the opening 44 and/or the orifices 45 of the peripheral flap 43 of the control ferrule 41 (FIG. 5).

In operation, as shown in FIG. 5, when the pressurized air or gas supplied from the passage 15 and the mouth 16 of the handle 14 to the conduit 13 of the receptacle 10 and then to the pathway 33 of the connector 30 and also to the path 22 of the end cap 20 is over pressurized, the excessive pressurized air or gas may force the skirt 53 of the valve device 50 away from the rear portion 25 of the end cap 20 and thus to selectively open the compartment 24 and/or the path 22 of the end cap 20, and thus to allow the pressurized air or gas to flow out through the opening 44 and/or the orifices 45 of the peripheral flap 43 of the control ferrule 41, such that the pressure of the pressurized air or gas may be adjusted or regulated.

Accordingly, the pneumatic dispensing gun in accordance with the present invention includes an adjusting or pressure regulating device for regulating the pneumatic pressure and for suitably or adjustably dispensing the flowable materials from the prefilled packages or cartridges.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A pneumatic dispensing gun comprising:

a receptacle including a conduit formed therein for receiving a pressurized gas, a cartridge supported on said receptacle and including one end portion, an end cap attached to said one end portion of said cartridge, and including a path formed therein for communicating with said conduit of said receptacle and for communicating with said one end portion of said cartridge and for supplying the pressurized gas into said cartridge, a regulating device attached to said end cap for regulating the pressurized gas, said regulating device including a valve device resiliently engaged with said end cap and for selectively blocking said path of said end cap, said valve device including a spring biasing means for biasing said valve device to resiliently engage with said end cap, a coupler attached to said valve device, and said spring biasing means including a spring member engaged with said coupler for biasing said valve device to resiliently engage with said end cap, a control ferrule attached to said end cap and including a chamber formed in said control ferrule, and an anchor disposed in said chamber of said control ferrule and engaged with said spring member.

2. The pneumatic dispensing gun as claimed in claim 1, wherein said end cap includes a compartment formed in a rear portion of said end cap and communicating with said path of said end cap, and said valve device is slidably disposed and engaged in said compartment of said end cap.

3. The pneumatic dispensing gun as claimed in claim 1, wherein said valve device includes a casing and a frustum-shaped skirt extended from said casing for resiliently engaging with said end cap.

4. The pneumatic dispensing gun as claimed in claim 3, wherein said valve device includes a recess formed in said casing and facing toward said path of said end cap.

5. The pneumatic dispensing gun as claimed in claim 1, wherein said anchor includes a cavity formed therein for receiving said spring member.

6. The pneumatic dispensing gun as claimed in claim 1, wherein said coupler includes an extension extended therefrom for engaging with said spring member and for anchoring said spring member.

7. The pneumatic dispensing gun as claimed in claim 1, wherein said valve device includes a casing, and said coupler includes a depression formed by a peripheral wall for receiving said casing and for anchoring said coupler to said valve device.

8. The pneumatic dispensing gun as claimed in claim 1, wherein said control ferrule includes a peripheral flap extended radially and inwardly for forming an opening in said peripheral flap of said control ferrule, and said anchor includes a protrusion extended therefrom and engaged through said opening of said control ferrule for anchoring said anchor to said control ferrule.

9. The pneumatic dispensing gun as claimed in claim 8, wherein said peripheral flap of said control ferrule includes a plurality of orifices formed therein, and arranged around said opening of said peripheral flap for air circulating purposes.

10. The pneumatic dispensing gun as claimed in claim 1, wherein said control ferrule is adjustably attached to said end cap.

11. The pneumatic dispensing gun as claimed in claim 1, wherein a connector is attached to said end cap, and a tube includes a first end secured to said receptacle and a second end slidably and adjustably engaged with said connector, and said tube includes a bore formed therein and communicating with said conduit of said receptacle.

12. The pneumatic dispensing gun as claimed in claim 11, wherein said connector includes a first segment attached to said end cap, and a second segment, and includes a pathway formed in said first segment and said second segment, said second end of said tube is slidably and adjustably engaged in said pathway of said connector.

13. The pneumatic dispensing gun as claimed in claim 1, wherein said receptacle includes a handle extended from said receptacle and having a passage formed in said handle and communicating with said conduit of said receptacle.

* * * * *